US007806401B2

(12) United States Patent
Fukao

(10) Patent No.: US 7,806,401 B2
(45) Date of Patent: Oct. 5, 2010

(54) MEDIUM FEEDING APPARATUS

(75) Inventor: Moriaki Fukao, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/386,096

(22) Filed: Mar. 22, 2006

(65) Prior Publication Data

US 2006/0214355 A1 Sep. 28, 2006

(30) Foreign Application Priority Data

Mar. 23, 2005 (JP) ..... 2005-084260

(51) Int. Cl.
*B65H 3/52* (2006.01)

(52) U.S. Cl. ..... 271/124; 271/4.03; 271/10.03

(58) Field of Classification Search ..... 271/124, 271/10.03, 4.03
See application file for complete search history.

(56) References Cited

U.S. PATENT DOCUMENTS 5,927,703 A * 7/1999 Endo ..... 271/10.03
6,378,858 B1 * 4/2002 Suga ..... 271/10.01
6,508,465 B1 * 1/2003 Endo ..... 271/265.01
7,384,032 B2 * 6/2008 Sata ..... 271/110
2002/0060397 A1 * 5/2002 Endo ..... 271/121
2004/0021262 A1 * 2/2004 Yen et al. ..... 271/10.11
2006/0202408 A1 * 9/2006 Yasui et al. ..... 271/242

FOREIGN PATENT DOCUMENTS

JP 8-301500 11/1996
JP 2000-203736 7/2000
JP 2001-180835 3/2001

* cited by examiner

*Primary Examiner*—Saúl J Rodríguez
*Assistant Examiner*—Howard Sanders
(74) *Attorney, Agent, or Firm*—Rabin & Berdo, PC

(57) ABSTRACT

A medium feeding apparatus includes a feeding roller for picking up a sheet member, a separating member pressed against the feeding roller by a predetermined pressing force, for separating the sheet members sheet by sheet, a conveyance roller for conveying the separated sheet member, a sheet member detector for detecting the sheet member, disposed at an upstream side with respect to the conveyance roller in a direction of conveying the sheet member, and a pressing force varying processor for varying a pressing force during a period after the sheet member detector detects the sheet member before the conveyance roller starts conveyance of the sheet member.

12 Claims, 4 Drawing Sheets

MEDIUM FEEDING APPARATUS

BACKGROUND OF THE INVENTION

1. Field of the Invention

This invention relates to a medium feeder.

2. Description of Related Art

A conventional information processing apparatus such as a printer, a photocopier, a facsimile machine, a multifunctional apparatus, for example, a conventional printer is installed with a paper feeder serving as a medium feeding apparatus to feed a paper as a medium as well as a sheet member. The paper feeder is to be installed with a paper separator which enables the paper feeder to feed the papers upon separating sheet by sheet.

FIG. 2 is a schematic view of a conventional paper feeder.

As shown in FIG. 2, a separating pad 16 is pressed against a feeding roller 11 by a predetermined pressing force to sandwich a paper 12 between the feeding roller 11 and the separating pad 16. Each frictional force between the papers 12 is lower than each of frictional forces between the paper 12 and the feeding roller 11, and between the paper 12 and the separating pad 16, so that the paper 12 in contact with the feeding roller 11 is conveyed with the feeding roller 11 in association with rotation of the feeding roller 11 in a direction of arrow a, thereby being separated from the other papers 12 remaining under a frictional force of the separating pad 16.

Numeral 13 is a paper tray; numeral 14 is a receiving plate; numeral 15 is a paper sensor; numeral 17 is a separating pad frame; numeral 18 is a spring; and numeral 22 is a guide.

In the meanwhile, such a pressing force of the separating pad 16 as capable of separating the paper 12 without problems differs depending on a condition of the paper 12, such as a type, a thickness, a size, a usage environment, and the like.

Therefore, such a paper feeder has been provided, as feeding the paper upon varying a pressing force of the separating pad 16 according to a type of the paper previously input into the printer (see, e.g., Japanese Patent Laid-Open No. 2001-180835).

The conventional paper feeder described above, however, cannot necessarily feed the paper smoothly in a case where the a feeding unit composed of a regist roller, not shown, and the like is disposed at a downstream side of the feeding roller 11 in a direction of conveying the paper 12. For example, in a case of using a thin paper, the paper undesirably gets wrinkled where a pressing force of the separating pad 16 is increased.

This invention aims to solve the above described problems in the conventional paper feeder and to provide a medium feeding apparatus capable of feeding a sheet member smoothly.

SUMMARY OF THE INVENTION

For the reasons stated above, a medium feeding apparatus according to this invention includes a feeding roller for picking up a sheet member, a separating member pressed against the feeding roller by a predetermined pressing force, for separating the sheet members sheet by sheet, a conveyance roller for conveying the separated sheet member, a sheet member detector for detecting the sheet member, disposed at an upstream side with respect to the conveyance roller in a direction of conveying the sheet member, and a pressing force varying processor for varying a pressing force during a period after the sheet member detector detects the sheet member before the conveyance roller starts conveyance of the sheet member.

According to this invention, the medium feeding apparatus includes the feeding roller for picking up the sheet member, the separating member pressed against the feeding roller by the predetermined pressing force, for separating the sheet members sheet by sheet, the conveyance roller for conveying the separated sheet member, the sheet member detector for detecting the sheet member, disposed at an upstream side with respect to the conveyance roller in the direction of conveying the sheet member, and the pressing force varying processor for varying the pressing force during the period after the sheet member detector detects the sheet member before the conveyance roller starts conveyance of the sheet member.

In this case, a pressing force is varied during a period after a sheet member detector detects the sheet member before the conveyance roller starts conveyance of the sheet member.

The sheet member thus can be fed smoothly.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Hereinafter, specific embodiments of this invention will be described in detail in reference with drawings. Explained is such a paper feeder in a printer serving as an image forming apparatus, as serving as a medium feeding apparatus for feeding a paper as a medium as well as a sheet member.

Figure 1:
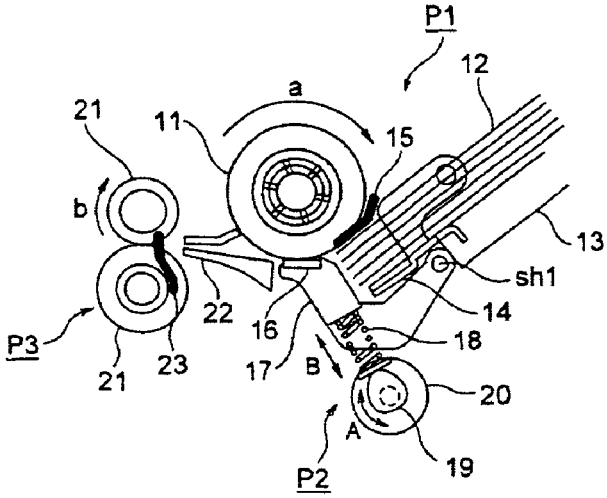
FIG. 1 is schematic view of a paper feeder according to the first embodiment of this invention.
Figure 2:
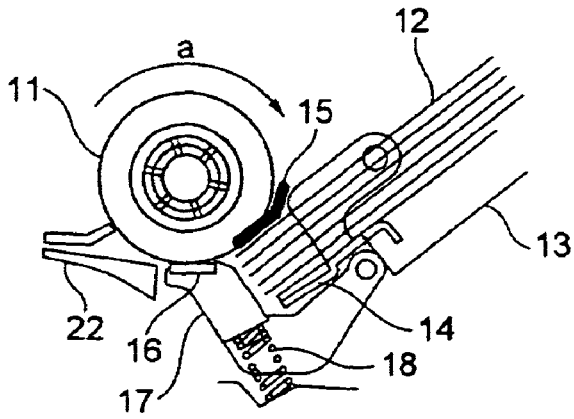
FIG. 2 PRIOR ART
FIG. 2 is a schematic view of a conventional paper feeder.

FIG. 1 is schematic view of a paper feeder according to the first embodiment of this invention.

In FIG. 1, notation P1 is a paper feeding unit serving as a medium feeding unit for picking up a paper 12; notation P2 is a paper separating unit serving as a medium separating unit for separating the papers 12 sheet by sheet; and notation P3 is a regist roller feeding unit serving as a conveyance roller feeding unit for further conveying the paper 12 picked up with the paper feeding unit P1.

The paper feeding unit P1 has a feeding roller 11 serving as a pick-up member, a feeding motor, not shown, serving as a driving unit used for pick-up operation, for rotating the feeding roller 11, a paper tray 13 serving as a medium container having the paper 12 set therein, and a receiving plate 14 disposed at a lower position of a front end of the paper tray 13, for receiving the paper 12 as well as operated at the time of picking up the paper 12 from the paper tray 13. The paper tray 13 is installed with a paper sensor 15 serving as a contained medium detector as well as a first sheet member detector, which detects the paper 12 set inside the paper tray 13.

The feeding roller 11 has an outer circumference thereof made of a rubber member such as EPDM (Ethylene Propylene Diene Monomer), in which such a surface thereof as brought in contact with the paper 12, is in a flat and smooth form or in a form having an elephant skin texture or a knurled texture for improvement of feeding capability. A one-way clutch is disposed between the feeding roller 11 and the feeding motor, and is locked while the feeding roller 11 is rotated in the direction of feeding the paper 12, i.e., in the direction of arrow a, where the feeding motor is driven in the direction of feeding the paper 12. On the other hand, the one-way clutch is released while the feeding roller 11 is not to be rotated where the feeding motor is stopped or rotated in a direction opposite to the direction of feeding the paper 12. In this state, where the paper 12 in contact with the feeding roller 11 is conveyed in a feeding direction, the feeding roller 11 is rotated in association with conveyance of the paper 12. The receiving plate 14 is to be movable upon driving a receiving plate motor serving as a driving unit for a receiving plate, independently disposed, but is to be movable as well by using a cam or the like upon application of power from the feeding motor.

The paper separating unit P2 has a separating pad frame 17 serving as a supporting frame disposed as shakable with a shaft sh1 as a pivotal center, a separating pad 16 serving as a separating member secured to a front end of the separating pad frame 17 with a double-face tape or adhesive, disposed as pressed by a predetermined pressing force against the feeding roller 11, a spring 18 having one end thereof in contact with a predetermined position of the separating pad frame 17, serving as an urging member for pressing the separating pad 16 against the feeding roller 11 by a predetermined pressing force (urging force), and a pressing force varying mechanism for pressing the other end of the spring 18 as well as varying the pressing force. In this embodiment, urethane is used for the separating pad 16 but a rubber, a cork, or the like may be used.

The pressing force varying mechanism has a cam 19 disposed as in contact with the other side of the spring 18 and a pressing force varying motor 20 serving as a driving unit used for varying a pressing force, in which the spring 18 is extended and contracted in a direction of arrow B to vary a pressing force for pressing the separating pad 16 against the feeding roller 11 where the pressing force varying motor 20 is driven to vary an angle of rotation in stages under control so the cam 19 as to be rotated in a direction of arrow A. In the meanwhile, instead of using the cam 19 as the pressing force varying mechanism, a gear, a rack, a solenoid, or the like may be usable.

The regist roller feeding unit P3 has a pair of regist rollers 21 serving as a conveyance roller, a regist motor, not shown, serving as a driving unit for regist for rotating each of the rotating the regist rollers 21, a guide 22 for guiding the paper 12 fed with the paper feeding unit P1 in a manner that the paper 12 passes through a gap between the regist rollers 21. Furthermore, a regist-in sensor 23 serving as a second sheet member detector is disposed at an upstream side of each of the regist rollers 21 in the direction of conveying the paper 12. The regist-in sensor 23 detects whether the paper 12 hits the gap between the regist rollers 21.

The regist rollers 21 are disposed as in contact with each other, as pressurizing each other upwardly and downwardly, in which one regist roller 21 is made of metal so as to be able to withstand being hit by the front end of the paper 12 while the other regist roller 21 is made of rubber to obtain a frictional force. The one-way clutch is disposed at either of the regist rollers 21, i.e., the regist roller 21 at an upper side in this embodiment, and the regist motor. The one-way clutch is locked while the regist roller 21 is rotated in the direction of conveying the paper 12, i.e., in a direction of arrow b, where the regist roller is driven in the direction of conveying the paper 12. On the other hand, the one-way clutch is released while the regist roller 21 is not to be rotated where the regist motor is stopped or rotated in a direction opposite to the direction of feeding the paper 12. In the meanwhile, a common motor is usable instead of the feeding motor and the regist motor, thereby being able to rotate the feeding roller 11 or the regist roller 21 upon driving the common roller in a positive direction or a negative direction.

Each of the feeding motor, the regist motor, the receiving plate motor, and the pressing force varying motor 20 is connected to a controller disposed at a control board, not shown, and the controller controls each of the motors. A sensor output from each of the paper sensor 15 and the regist-in sensor 23 is input to the controller. The controller is connected to an input device, not shown, in which a condition of the paper 12, such as a type (e.g., an overhead transparency, an envelope, or the like), a thickness, a size, or the like, can be input as a parameter of the paper 12, by operating the input device.

Operation of the paper feeder thus structured is explained next.

Figure 3:
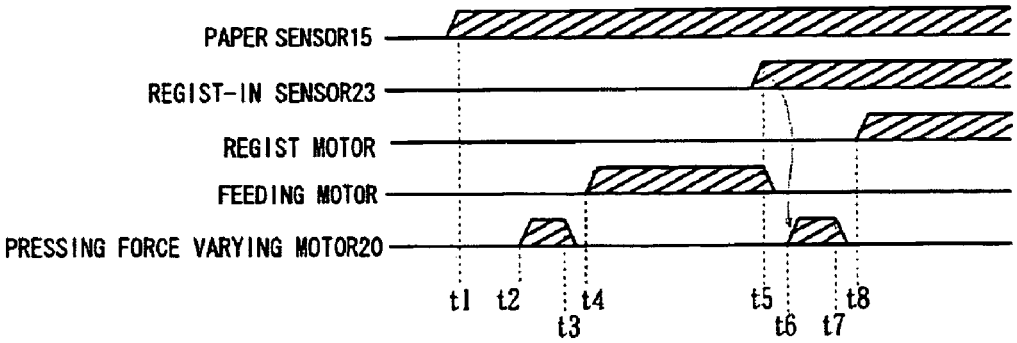
FIG. 3 is a time chart showing operation at the time of feeding a paper according the first embodiment of this invention.
Figure 4:
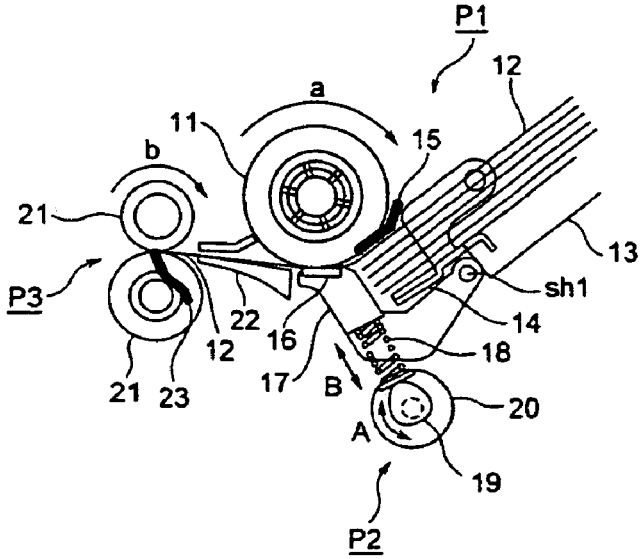
FIG. 4 is a view showing operation of the paper feeder according to the first embodiment of this invention.
Figure 5:
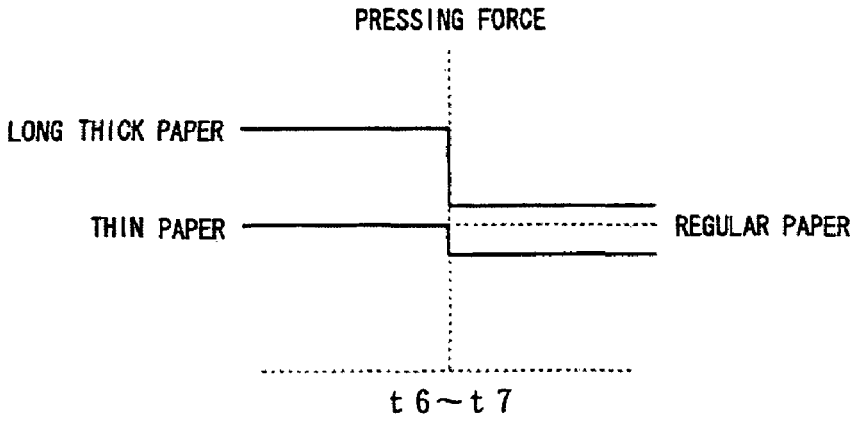
FIG. 5 is a view illustrating a pressing force according to the first embodiment of this invention.

FIG. 3 is a time chart showing operation at the time of feeding a paper according the first embodiment of this invention. FIG. 4 is a view showing operation of the paper feeder according to the first embodiment of this invention. FIG. 5 is a view illustrating a pressing force according to the first embodiment of this invention.

An operator inputs a parameter of the paper 12 in use by operating the input device first. In the meanwhile, the operator can input the parameter of the paper 12 through a personal computer or the like, instead of operating the input device.

Subsequently, where the operator sets on the paper tray 13 the paper 12 which the parameter is already input, the paper sensor 15 detects the paper 12 inside the paper tray 13 at the timing of t1. Where the operator then enters a feeding command by operating the input device or the personal computer, a pressing force varying processor of the controller executes a pressing force varying process at the timing of t2, thereby driving the pressing force varying motor 20 to vary a pressing force by the separating pad 16 according to the parameter of the paper 12 in use.

Compared to a pressing force in using a regular paper, a pressing force is set to 1.5 to 1.7 times stronger in using the long thick paper 12 while being set to substantially equal to or slightly smaller in using the thin paper 12, as shown in FIG. 5.

A medium feeding processor of the controller thereafter executes a medium feeding process in a case of completion of the pressing force varying process at the timing of t3, thereby driving the receiving plate motor to rotate the receiving plate 14 in clockwise direction in FIG. 4 so as to press the front end of the paper 12 against the feeding roller 11. The medium feeding processor subsequently drives the feeding motor at the timing of t4 to rotate the feeding roller 11, thereby starting to feed the paper 12.

A couple of papers 12 then enter together into a gap between the feeding roller 11 and the separating pad 16 by a frictional force between the papers 12 in association with rotation of the feeding roller 11, but the separating pad 16 separates the papers 12 to pick up one sheet.

The guide 22 subsequently guides the picked-up paper 12, and the front end of the paper 12 hits the regist roller 21 at the timing of t5, thereby turning the regist sensor 23 on. In this bout, the medium feeding processor suspends driving of the feeding motor. The pressing force varying processor thereafter varies a pressing force at the timing of t6, according to the parameter, to a value suitable for the regist roller 21 to convey the paper 12. At this time, a pressing force is set, compared to a pressing force in using a regular paper, to approximately 1.1 to 1.5 times stronger in using the long thick paper 12 while being set to approximately 0.7 times stronger in using the thin paper 12, as shown in FIG. 5.

A medium conveying processor of the controller executes a medium conveying process at the timing of t8 in a case of completion of the pressing force varying process at the timing of t7, thereby driving the regist motor to rotate the regist roller 21 so as to start conveyance of the paper 12.

As described above, a pressing force is to be varied according to the parameter of the paper 12 during a period after the regist sensor 23 detects the paper 12 before the regist roller 21 starts conveyance of the paper 12 in this embodiment, so that such problems unique to each type of the paper 12 can be prevented from occurring. It is possible to prevent such cases where the paper 12 gets wrinkled in using the thin paper 12, for example, and where a few sheets of the papers 12 are conveyed together in using the long thick paper 12. The paper 12 therefore can be fed smoothly.

The second embodiment is next described. It is to be noted that the elements substantially the same as those in the first embodiment are assigned with the same reference numbers so that those duplicated description are omitted, and description for the first embodiment is quoted for the effects resulted from the structures substantially the same as the first embodiment.

Figure 6:
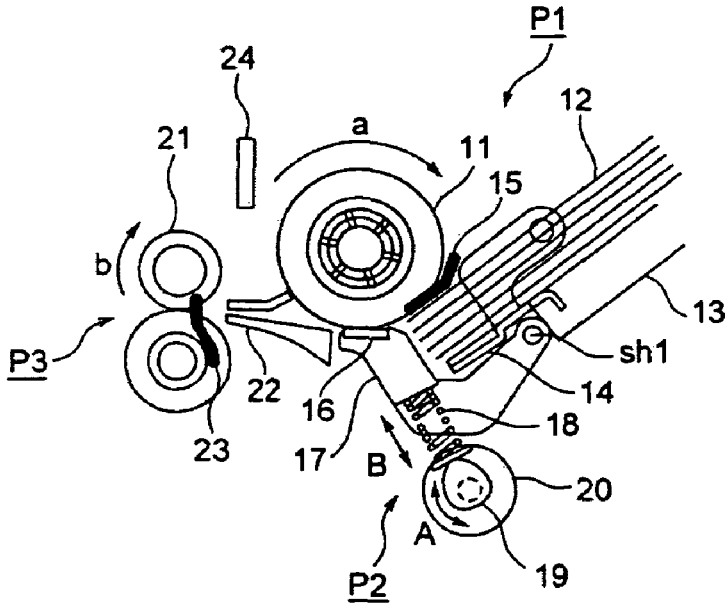
FIG. 6 is a schematic view of a paper feeder according to the second embodiment of this embodiment.
Figure 7:
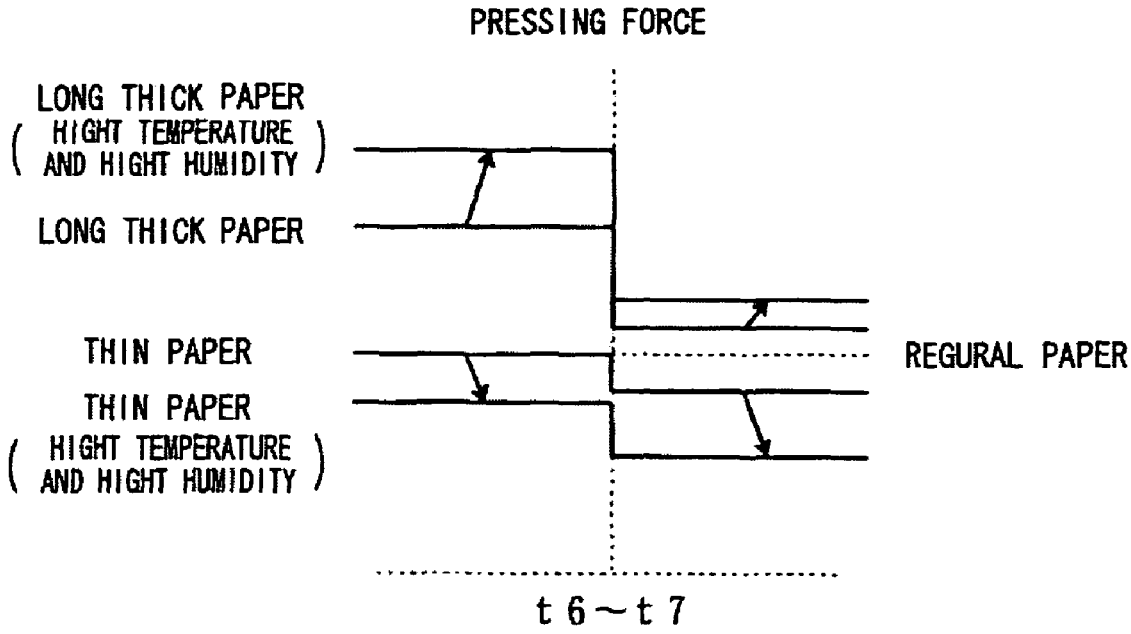
FIG. 7 is a view illustrating a pressing force according to the second embodiment of this invention.

FIG. 6 is a schematic view of a paper feeder according to the second embodiment of this embodiment. FIG. 7 is a view illustrating a pressing force according to the second embodiment of this invention.

In this case, a temperature and humidity sensor 24 serving as a usage environment detector is disposed between a paper feeding unit P1 and the regist roller feeding unit P3 and is connected to the controller. The temperature and humidity sensor 24 detects a temperature and a humidity as a usage environment of the printer, thereby transmitting the detected temperature and humidity to the controller.

A pressing force correcting processor of the controller executes a pressing force correcting process to read a temperature and a humidity as the parameter of the paper 12 and handles the read temperature and the humidity together with the parameter of the paper 12 input through the input device, as a factor for correcting a pressing force of the separating pad 16 serving as a separating member.

The paper 12 easily gets wrinkled under such a usage environment as a high temperature and humidity in a case of using the thin paper 12, for example, but a frictional force between the papers 12 is increased, so that the pressing force correcting processor reduces a pressing force as indicated with a dashed line in FIG. 7. In this case, the paper 12 can be picked up with the feeding roller 11 serving as the pick-up member and be conveyed with the regist roller 21 serving as the conveyance roller.

A frictional force between the papers 12 increases under such a usage environment as a high temperature and humidity in a case of using the long thick paper, so that a few sheets of the papers 12 are easily conveyed together, and therefore the pressing force correcting processor increases a pressing force as indicated with the dashed line in FIG. 7.

As described above, a pressing force can be corrected according to a usage environment in this embodiment, so that the sheet 12 can be conveyed more smoothly.

It is to be noted that this invention is not limited to the above described embodiment but can be arbitrarily modified based on the purpose of this invention, and those modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A medium feeding apparatus, comprising:

a feeding roller for picking up and feeding at least one sheet member from a plurality of sheet members;

a separating member pressed against the feeding roller by a first pressing force which is effective to separate the sheet members sheet by sheet so that a separated sheet member is fed in cooperation with the feeding roller in a feeding direction;

a conveyance roller disposed downstream of the feeding roller for conveying the separated sheet member in a conveying direction;

a sheet member detector disposed downstream of the feeding roller and upstream of the conveyance roller for detecting the separated sheet member; and a pressing force varying mechanism and processor means for controlling the pressing force varying mechanism to decrease the pressing force of the separating member from the first pressing force suitable for the feeding roller to a second pressing force suitable for the conveyance roller, during the feeding of the separated sheet member, after the sheet member detector detects the separated sheet member but before the conveyance roller starts conveyance of the separated sheet member, wherein the feeding roller is not driven while the conveyance roller conveys the separated sheet member.

2. The medium feeding apparatus according to claim 1, further comprising:

a usage environment detector for detecting a usage environment including temperature and humidity of the medium feeding apparatus; and correcting processor means for correcting the pressing force according to the usage environment, wherein the first pressing force of the separating member is selected based on the thickness of the sheet member, and wherein the correcting processor means increases one or both of the first pressing force and the second pressing force when the sheet member is a sheet of thick paper having a thickness which is greater than that of the nominal sheet member and the usage environment detector detects temperature and humidity which exceed predetermined values.

3. The medium feeding apparatus according to claim 2, wherein the correcting processor means is a pressing force correcting processor.

4. The medium feeding apparatus according to claim 1, further comprising:

a usage environment detector for detecting a usage environment including temperature and humidity of the medium feeding apparatus; and correcting processor means for correcting the pressing force according to the usage environment, wherein the first pressing force of the separating member is selected based on the thickness of the sheet member, wherein the correcting processor means decreases one of both of the first pressing force and the second pressing force when the sheet member is a sheet of thin paper having a thickness which is less than that of the nominal sheet member and the usage environment detector detects a temperature and humidity above predetermined values.

5. The medium feeding apparatus according to claim 4, wherein the correcting processor means is a pressing force correcting processor.

6. The medium feeding apparatus according to claim 1, wherein the processor means is a pressing force varying processor.

7. A medium feeding apparatus, comprising:

a feeding roller for picking up and feeding at least one sheet member from a plurality of sheet members;

a separating member pressed against the feeding roller by a first pressing force which is effective to separate the sheet members sheet by sheet so that a separated sheet member is fed in cooperation with the feeding roller in a feeding direction;

a conveyance roller disposed downstream of the feeding roller for conveying the separated sheet member in a conveying direction;

a sheet member detector disposed downstream of the feeding roller and upstream of the conveyance roller for detecting the separated sheet member; and a pressing force varying mechanism and processor means for controlling the pressing force varying mechanism to decrease the pressing force of the separating member from the first pressing force suitable for the feeding roller to a second pressing force suitable for the conveyance roller, during the feeding of the separated sheet member, after the sheet member detector detects the separated sheet member but before the conveyance roller starts conveyance of the separated sheet member, wherein the second pressing force is larger when the sheet member is a sheet of thick paper than when the sheet member is a nominal sheet member of regular paper having a thickness which is less than that of the sheet of thick paper, and wherein the feeding roller is not driven while the conveyance roller conveys the separated sheet member.

8. The medium feeding apparatus according to claim 7, further comprising a usage environment detector for detecting a usage environment including temperature and humidity of the medium feeding apparatus, wherein the processor means increases one or more of the first pressing force and the second pressing force when the sheet member is a sheet of thick paper having a thickness which is greater than that of the nominal sheet member and the usage environment detector detects temperature and humidity exceeding predetermined values.

9. The medium feeding apparatus according to claim 7, wherein the processor means is a pressing force varying processor.

10. A medium feeding apparatus, comprising:

a feeding roller for picking up and feeding at least one sheet member from a plurality of sheet members;

a separating member pressed against the feeding roller by a first pressing force which is effective to separate the sheet members sheet by sheet so that a separated sheet member is fed in cooperation with the feeding roller in a feeding direction;

a conveyance roller disposed downstream of the feeding roller for conveying the separated sheet member in a conveying direction;

a sheet member detector disposed downstream of the feeding roller and upstream of the conveyance roller for detecting the separated sheet member; and a pressing force varying mechanism and processor means for controlling the pressing force varying mechanism to decrease the pressing force of the separating member from the first pressing force suitable for the feeding roller to a second pressing force suitable for the conveyance roller, during the feeding of the separated sheet member, after the sheet member detector detects the separated sheet member but before the conveyance roller starts conveyance of the separated sheet member, wherein the second pressing force is smaller when the sheet member is a sheet of thin paper than when the sheet member is a nominal sheet member of regular paper having a thickness which is greater than that of the sheet of thin paper, and wherein the feeding roller is not driven while the conveyance roller conveys the separated sheet member.

11. The medium feeding apparatus according to claim 10, further comprising a usage environment detector for detecting a usage environment including temperature and humidity of the medium feeding apparatus, wherein the processor means decreases one or more of the first pressing force and the second pressing force when the sheet member is the sheet of thin paper and the usage environment detector detects temperature and humidity exceeding predetermined values.

12. The medium feeding apparatus according to claim 10, wherein the processor means is a pressing force varying processor.

* * * * *